US008091617B2

(12) United States Patent
Kirschenmann

(10) Patent No.: US 8,091,617 B2
(45) Date of Patent: Jan. 10, 2012

(54) HEAT EXCHANGER

(75) Inventor: Timo Kirschenmann, Leinfelden-Echterdinge (DE)

(73) Assignee: Modine Manufacturing Company, Racine, WI (US)

( * ) Notice: Subject to any disclaimer, the term of this patent is extended or adjusted under 35 U.S.C. 154(b) by 1208 days.

(21) Appl. No.: 11/879,854

(22) Filed: Jul. 19, 2007

(65) Prior Publication Data

US 2008/0023187 A1 Jan. 31, 2008

(30) Foreign Application Priority Data

Jul. 21, 2006 (DE) ..... 10 2006 033 771

(51) Int. Cl.
*F28F 9/26* (2006.01)

(52) U.S. Cl. ..... 165/144; 165/174; 165/176

(58) Field of Classification Search ..... 165/76, 165/176, 178

See application file for complete search history.

(56) References Cited

U.S. PATENT DOCUMENTS

| | | | | | |
|---|---|---|---|---|---|
| 3,929,356 | A * | 12/1975 | DeVincent et al. | ..... | 285/305 |
| 5,040,831 | A * | 8/1991 | Lewis | ..... | 285/305 |
| 5,477,919 | A * | 12/1995 | Karube | ..... | 165/176 |
| 5,526,876 | A | 6/1996 | Karube | | |
| 5,593,187 | A * | 1/1997 | Okuda et al. | ..... | 285/305 |
| 5,685,366 | A | 11/1997 | Voss et al. | | |
| 6,679,319 | B1 | 1/2004 | Kato | | |
| 6,682,100 | B2 * | 1/2004 | Wood et al. | ..... | 285/26 |
| 2006/0137870 | A1 * | 6/2006 | Ohhashi et al. | ..... | 165/174 |
| 2006/0207756 | A1 * | 9/2006 | Takayanagi et al. | ..... | 165/153 |
| 2007/0144721 | A1 * | 6/2007 | Watanabe et al. | ..... | 165/174 |
| 2007/0193731 | A1 * | 8/2007 | Lamich et al. | ..... | 165/149 |

FOREIGN PATENT DOCUMENTS

| | | | |
|---|---|---|---|
| DE | 69824454 | | 6/2005 |
| DE | 69824454 | T2 | 6/2005 |
| EP | 0414433 | | 2/1991 |
| EP | 0953815 | | 11/1999 |
| EP | 0953815 | A2 | 11/1999 |
| EP | 1314946 | | 5/2003 |
| EP | 1314946 | A1 | 5/2003 |
| EP | 1413845 | | 4/2004 |
| JP | 09072630 | A * | 3/1997 |
| JP | 2001133192 | A * | 5/2001 |
| WO | WO 9913284 | | 3/1999 |
| WO | WO 03042611 | A1 * | 5/2003 |
| WO | WO 2004059235 | | 7/2004 |
| WO | WO 2004081481 | A1 * | 9/2004 |

* cited by examiner

*Primary Examiner* — Allen Flanigan

(74) *Attorney, Agent, or Firm* — Michael Best & Friedrich LLP

(57) ABSTRACT

A heat exchanger, such as a condenser or a gas cooler for an air-conditioning system of a motor vehicle, has at least two fin/tube cores which have, on two opposite sides of the fin/tube cores, at least two collecting tubes which can have a flow connection to one another. The collecting tubes can have connecting or junction members which each co-operate with a closure plate or separating plate in order to make the heat exchanger easier to manufacture.

18 Claims, 8 Drawing Sheets

HEAT EXCHANGER

CROSS-REFERENCE TO RELATED APPLICATIONS

Priority is hereby claimed to German Patent Application No. DE 10 2006 033 771.9 filed on Jul. 21, 2006, the entire contents of which are incorporated herein by reference.

BACKGROUND

A type of heat exchanger having two fin/tube cores and collecting tubes on opposite sides of the fin-tube cores is disclosed in European Patent Application No. EP 414 433 A2. Two collecting tubes of the disclosed heat exchanger have, as is shown in FIG. 12 of that document, a flow connection to one another by means of two junction members. Two junction members are each fitted onto one collecting tube as individual parts, and are brazed thereon. During subsequent assembly of the two fin/tube heat exchanger cores, the two junction members are screwed to one another. This heat exchanger, which is assembled after a brazing process, is not as stable under high pressures as it is with $CO_2$ as the refrigerant.

It is also known to equip the ends of collecting tubes with a slit in order to insert a closure plate therein.

Expenditures for the manufacture of known heat exchangers appears to be too high, and reflect the relative difficulty in such manufacturing based upon many current heat exchanger designs.

SUMMARY

Some embodiments of the present invention relate to a heat exchanger, such as (by way of example only) a condenser or a gas cooler for an air-conditioning system of a motor vehicle. The heat exchanger can have at least two fin/tube cores which have, on the two opposite sides thereof, at least two collecting tubes which have a flow connection to one another. In some embodiments, the collecting tubes have closure or separating plates, and connecting or junction members.

Since in some embodiments at least one connecting or junction member co-operates with at least one closure plate or separating plate, it is possible to dispense with temporary attachments (e.g., spot welding) when parts of the heat exchanger are assembled, thereby allowing for simpler and less costly manufacturing processes. Also, the pressure load bearing capacity and torsional strength of the resulting heat exchanger (e.g., condenser) can be improved. Furthermore, the closure or separating plate can act as a spacer element between collecting tubes.

In some embodiments, the collecting tubes and the connecting or junction member can have a slit at a common location, into which the closure or separating plate can be inserted. This method of assembly has been proven in trial practice.

However, as an alternative, it is possible to provide for a closure plate to have two bowl-shaped portions arranged beside one another, wherein each bowl-shaped portion can be inserted into a respective end of a collecting tube.

In some embodiments, it is possible for a connecting or junction member to be a transfer member for conducting medium from one collecting tube to another. It is equally satisfactory for the connecting or junction member to be an input member or an output member for feeding medium into or discharging medium from one or both collecting tubes.

There is provision in some embodiments for the interface between a junction member and a closure plate to take the form of a slit present in the junction member into which the closure plate is inserted. During assembly, the junction member is then firstly inserted between the two collecting tubes, and the closure plate is then inserted.

The closure separating plate can extend over adjacent collecting tubes or a single collecting tube.

In some embodiments, the flow connection between collecting tubes can either be approximately parallel to a closure or separating plate, or can instead span the closure or separating plate.

DETAILED DESCRIPTION

Figure 1:
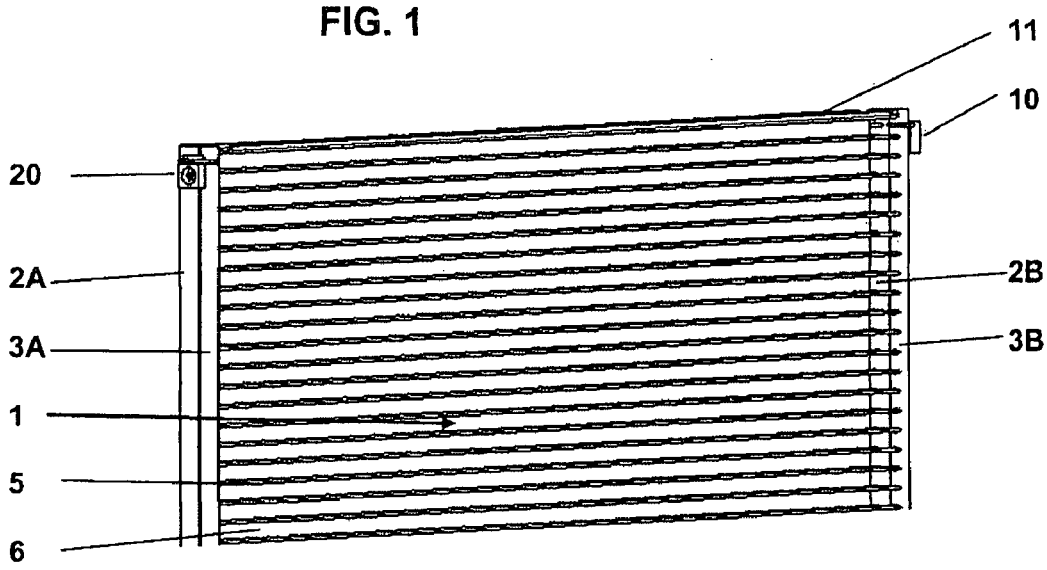
FIG. 1 is a perspective view of an upper half of a condenser according to an embodiment of the present invention.

FIG. 1 shows a view of part of a heat exchanger according to an embodiment of the present invention, such as a gas cooler, for using $CO_2$ as a refrigerant. The condenser (e.g., a gas cooler) has at least two fin/tube cores 1 constructed from tubes 5 and fins 6 between each pair of tubes 5, and a plurality of collecting tubes 2A, 2B, 3A, 3B at the tube ends for holding the refrigerant. In this type of condenser, two identical heat exchangers are positioned one behind the other, and are connected to one another in such a way that one of the collecting tubes 2A and 3A lies directly behind and is connected to the other, and another of the collecting tubes 2B and 3B also lies directly behind the other in the direction of flow of the cooling air. This design of condenser has the advantage that the entire surface of the fin/tube core 1 is available for exchanging heat. The first pair of collecting tubes 2A and 3A (shown on the left side of FIG. 1) and the second pair of collecting tubes 2B and 3B (shown on the right side of FIG. 1) are respectively connected to a connecting or junction member 10, 20 which co-operates with a closure or separating plate 4.

Figure 7:
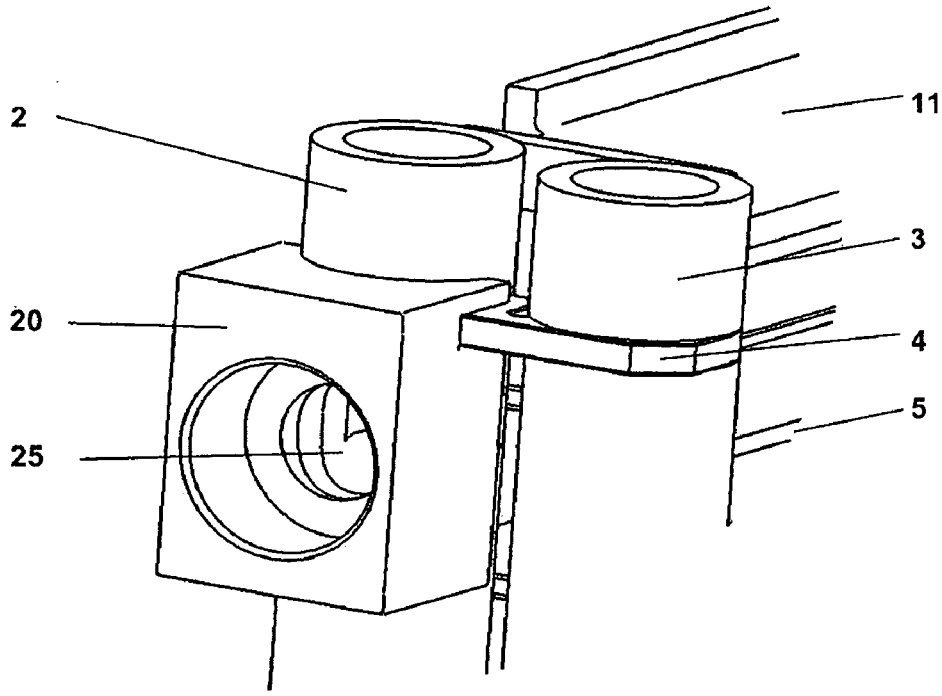
FIG. 7 is a detail perspective view of a junction and connecting member on a condenser according to another embodiment of the present invention.

Refrigerant is conducted into the rear collecting tube 2A via a junction and connecting member 20 (i.e., a member that both connects the tubes together and establishes fluid communication between the interiors of the tubes), an example of which is shown in FIG. 7. The refrigerant is also distributed via the flat tubes 5, and flows into the collecting tube 2B on the opposite side of the heat exchanger.

There, the junction and connecting member 10 conducts the refrigerant from the collecting tube 2B into the adjacent forward collecting tube 3B. Further necessary separating plates 4 for subdivisions of the collecting tubes 2 or 3 are not shown, but can be inserted as required, and can divert the refrigerant within the collecting tubes 2, 3 repeatedly. The closure plate or separating plate 4 can be used for such purposes, either in co-operation with a junction or connecting member 10, 20 or alone (i.e., without the junction or connecting member 10, 20). It is also possible for a plurality of junction or connecting members 10, 20 to be arranged on the collecting tubes 2 and 3 at any desired locations desired. Accordingly, the customary illustrations with closure or separating plates 4 located at the ends of the collecting tubes 2, 3 and with a junction or connecting member 10, 20 are not to be understood as a restriction to the present invention. Instead, it is to be understood that the closure or separating plate 4 can be located on just a single collecting tube 2 or 3, even though the illustrated designs show only closure or separating plates 4 extending over two adjacent collecting tubes 2 and 3.

Figure 2:
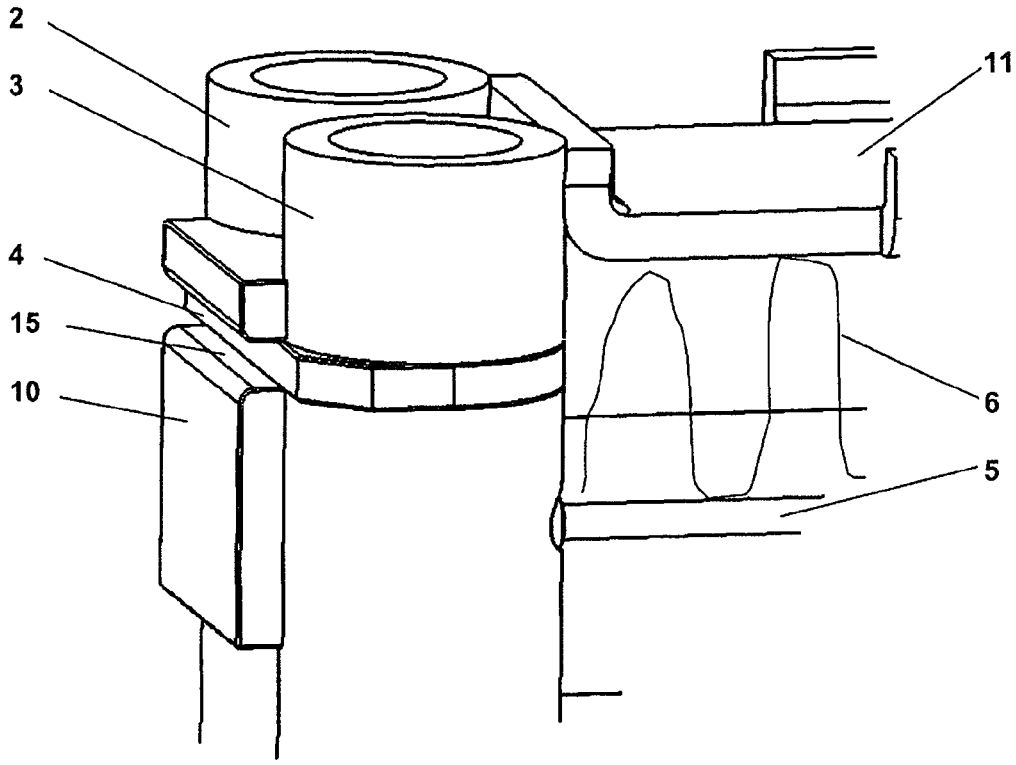
FIG. 2 is a detail perspective view of a corner of the condenser of FIG. 1, shown with a junction member.

FIG. 2 is an enlarged detail view of FIG. 1, in which one corner of the illustrated condenser is shown. As shown in FIG. 2, the two collecting tubes 2A and 3A are connected to a junction and connecting member 10. The closure plate 4 secures the junction and connecting member 10 at the desired points (in the illustrated case, in the region of the ends of the collecting tubes 2 and 3). Also with reference to FIG. 2, a flat tube 5 can be seen, as can a fin 6 and a side plate 11 extending over the entire width of the condenser.

Figure 3:
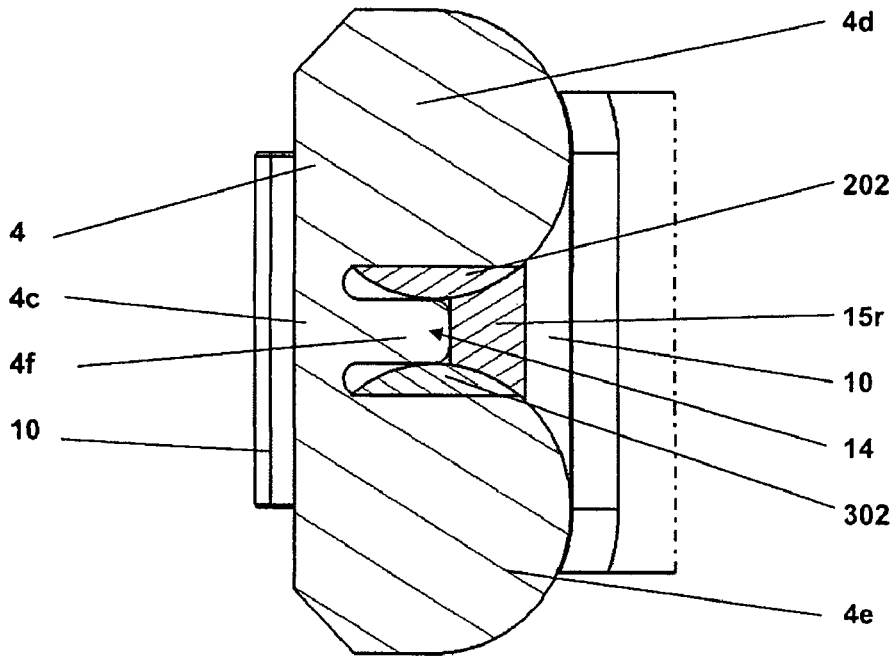
FIG. 3 is a horizontal sectional view of the corner of the condenser of FIG. 2, taken through the closure plate.

FIG. 3 is a section view of FIG. 2, taken through the closure plate 4. The illustrated closure plate 4 is approximately in the shape of a capital B. The two parts 4*d* and 4*e* of this shape in the illustrated embodiment are generally circular. In a central portion of the closure plate 4, these two parts 4*d*, 4*e* are connected by a web 4*c*, and from the latter a projection 4*f* extends into an intermediate space 14. This intermediate space 14 is formed from wall parts 202 of one collecting tube 2A, wall parts 302 of the other (adjacent) collecting tube 3A, and a portion 15*r* of the junction and connecting member 10 defining a slit 15 in the connecting member 10 (see FIG. 5). Depending on the shape of the collecting tubes 2 and 3, these parts 4*c*, 4*d*, 4*e*, 4*f*, 202, 302, and 15*r* can be shaped in such a way that the desired aim of preliminarily securing the junction and connecting member 10 by the closure plate 4 is achieved. After brazing, soldering, or another suitable joining process, a fixed and sealed structure is formed. In order to be able to insert the closure plate 4, the collecting tubes 2 and 3 must have respective slits 205, 305 at corresponding points. These slits 205, 305 are embodied in such a way to define parts 202, 302 of the collector wall 202, 302 in the central portion. Likewise, a slit 15 into which the closure plate 4 is inserted must be present in the junction or connecting member 10.

Figure 4:
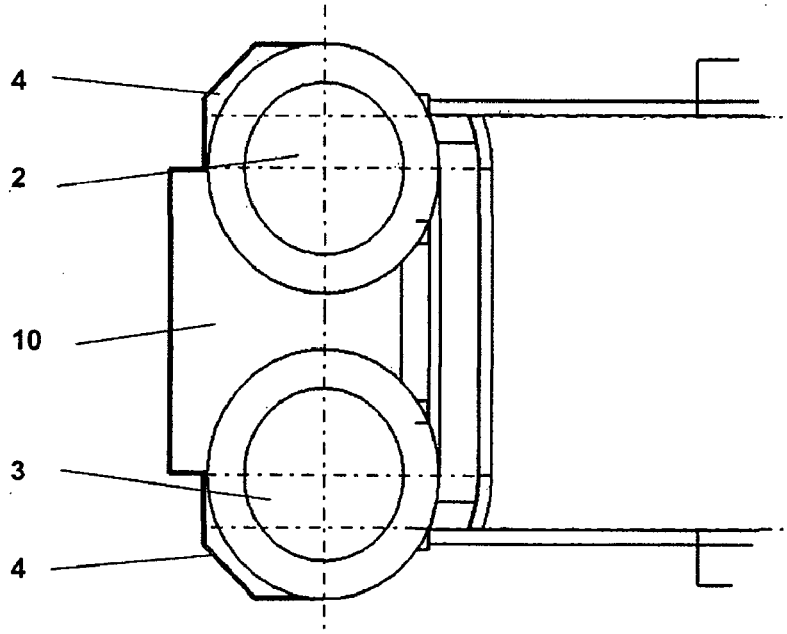
FIG. 4 is a plan view of the corner of the condenser of FIG. 2.

FIG. 4 is an end of the collecting tubes 2 and 3 in plan view. The junction and connecting member 10 and the closure plate 4 shown in FIG. 4 protrude somewhat. Alternatively, the closure plate 4 can be shaped to have two bowl-shaped bulges or other protrusions inserted into the ends of the collecting tubes 2 and 3 (not shown).

Figure 5:
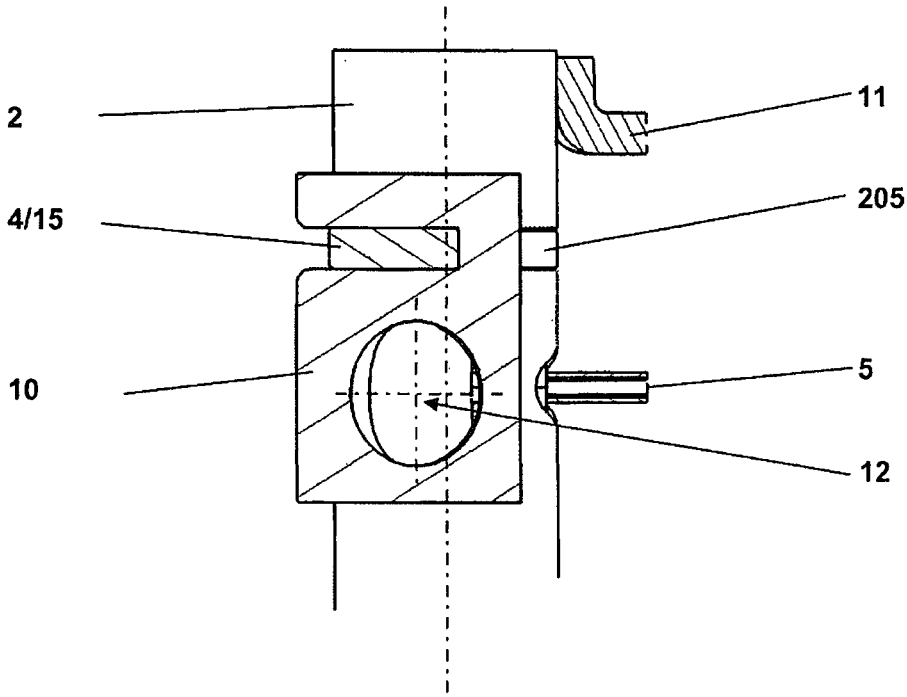
FIG. 5 is a vertical section view of the corner of the condenser of FIG. 2.
Figure 6:
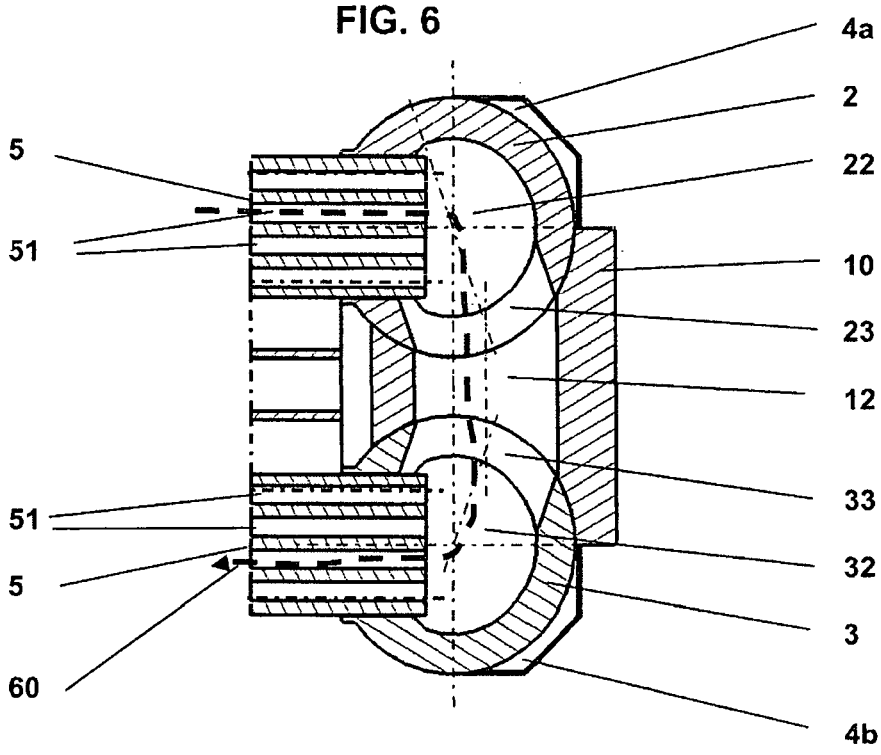
FIG. 6 is another horizontal section view of the corner of the condenser of FIG. 2, taken through the junction member shown in FIG. 2.

FIG. 5 is a different (vertical) section through the portion of the heat exchanger shown in FIG. 2, taken through the junction and connecting member 10. The slits 15 and 205 described above are visible in FIG. 5. With reference also to FIG. 6, the junction and connecting member 10 has a through-flow opening 12 through which refrigerant from one collecting tube 2 can flow to an adjacent collecting tube 3. Refrigerant flow is indicated in FIG. 6 by the dashed arrow 60. Refrigerant flows out of two fluid ducts 51 in the flat tubes 5 into a collector space 22 of one collecting tube 2. From there, the refrigerant flows through an opening 23 in the collecting tube 2 into the through-opening 12 in the junction and connecting member 10. The refrigerant then passes through an opening 33 in the other collecting tube 3 into a collecting space 32 in the other collecting tube 3 in order then to flow back into small fluid ducts 51 in another set of flat tubes 5.

FIG. 7 shows an alternative embodiment in which a junction or connecting member 20 according to another embodiment of the present invention is used. The junction or connecting member 20 has an inflow opening or outflow opening 25 through which refrigerant can pass into or out of the condenser. This junction or connecting member 20 is also pre-secured by the closure plate 4 in order to form a fluid-tight connection when brazed, soldered, or joined in any other suitable manner. By pre-securing the junction or connecting member 20 in this manner, the junction or connecting member 20 can no longer slip vertically (viewed from the orientation of the figures), and cannot drop down by virtue of being clamped tight in a brazing or soldering frame (not shown). The junction or connecting member 20 can be mounted at any desired location along the collecting tube 2, 3, but the collecting tube 2 or 3 in some embodiments must be closed at the upper or lower end by one or more individual closure plates 4.

Figure 8:
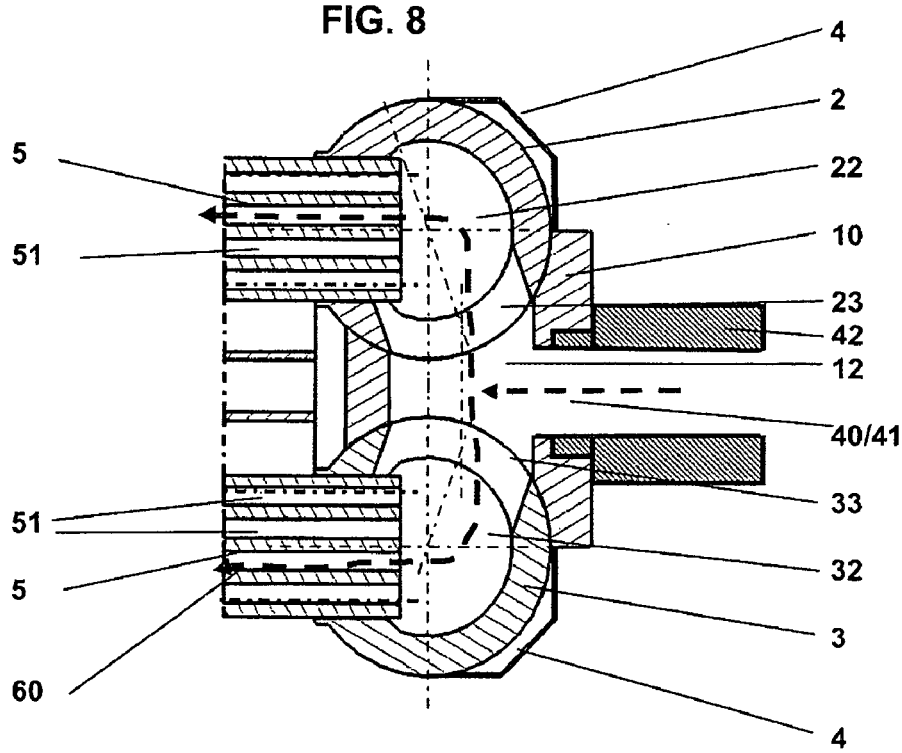
FIG. 8 is a connecting member according to another embodiment of the present invention.

A further alternative embodiment of a member 10 according to the present invention is illustrated in FIG. 8. In this embodiment, the member 10 is both a junction member and a connecting member 20. The refrigerant, indicated again by a dashed arrow 60, is fed through an inlet opening 41 of the through-flow opening 12 via feed lines 42 (not shown in detail). The refrigerant is distributed, as shown, through the two openings 23 and 33 in the respective collecting tubes 2 and 3 and to the collecting spaces 22 and 32, and then flows into the small fluid ducts 51 in the flat tubes 5.

Any of the members 10 or closure plates 4 described and illustrated herein can be used when there are more than two heat exchangers located adjacent one another, and can be used to connect such adjacent heat exchangers to one another. If, for example, three heat exchangers are positioned one behind the other (with respect to the direction of airflow therethrough), a member 10 can be configured in such a way that it connects just two of the three heat exchangers to the through-flow opening 12. In an extreme case, it is even possible to dispense with the through-flow opening 12 in order to attach only in a desired manner.

Figure 9:
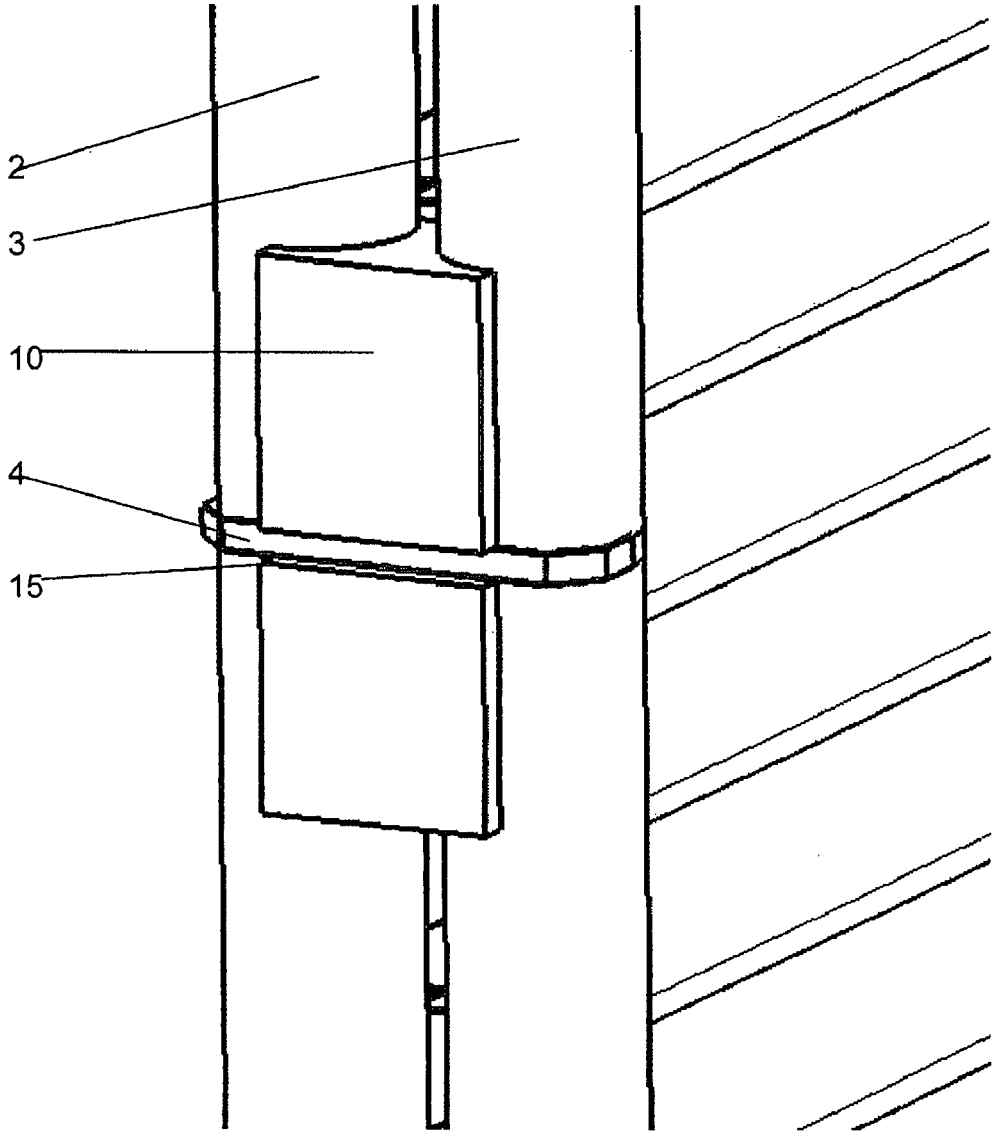
FIGS. 9-11 illustrate a junction or connecting member according to another embodiment of the present invention.
Figure 10:
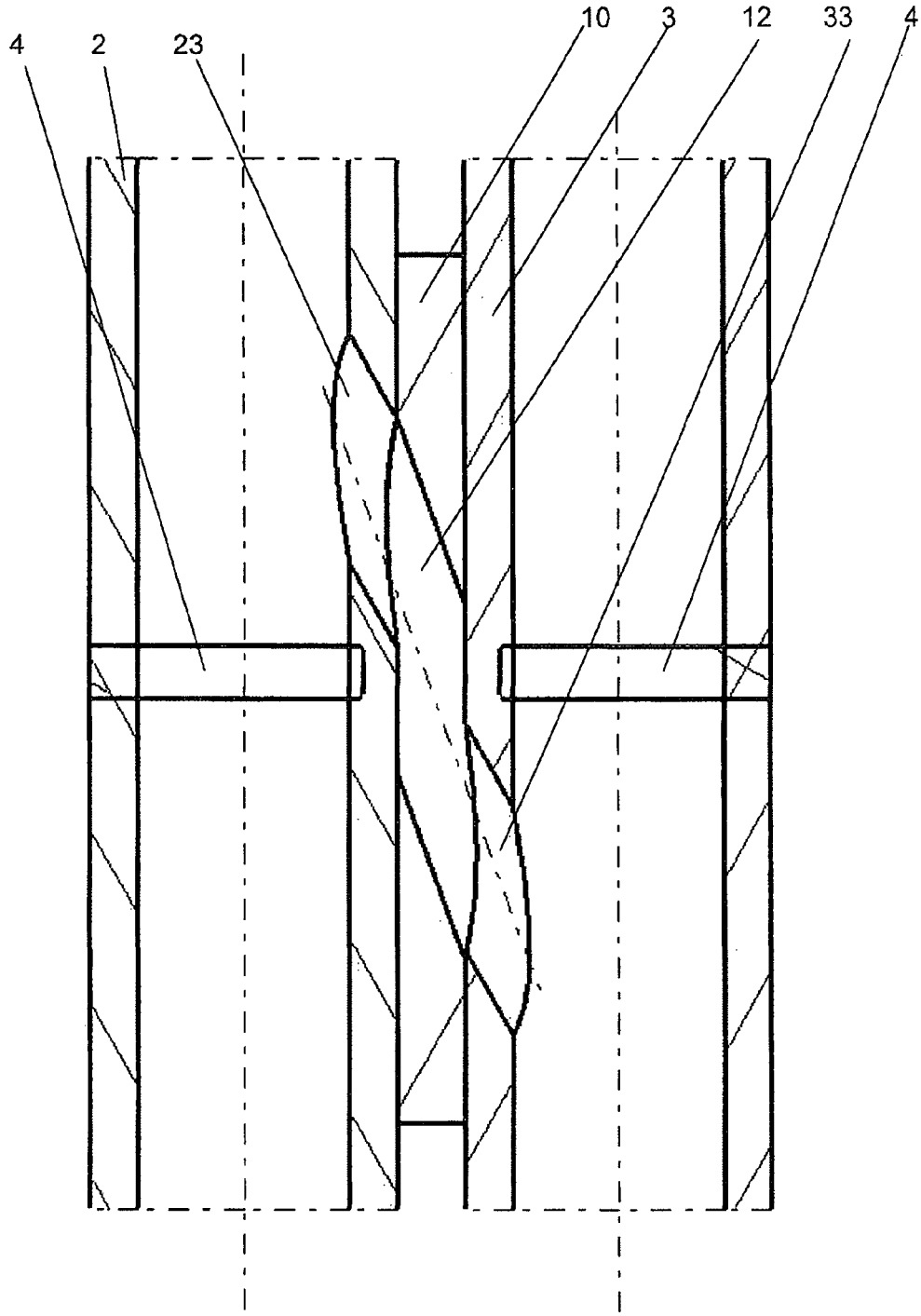
Figure 11:
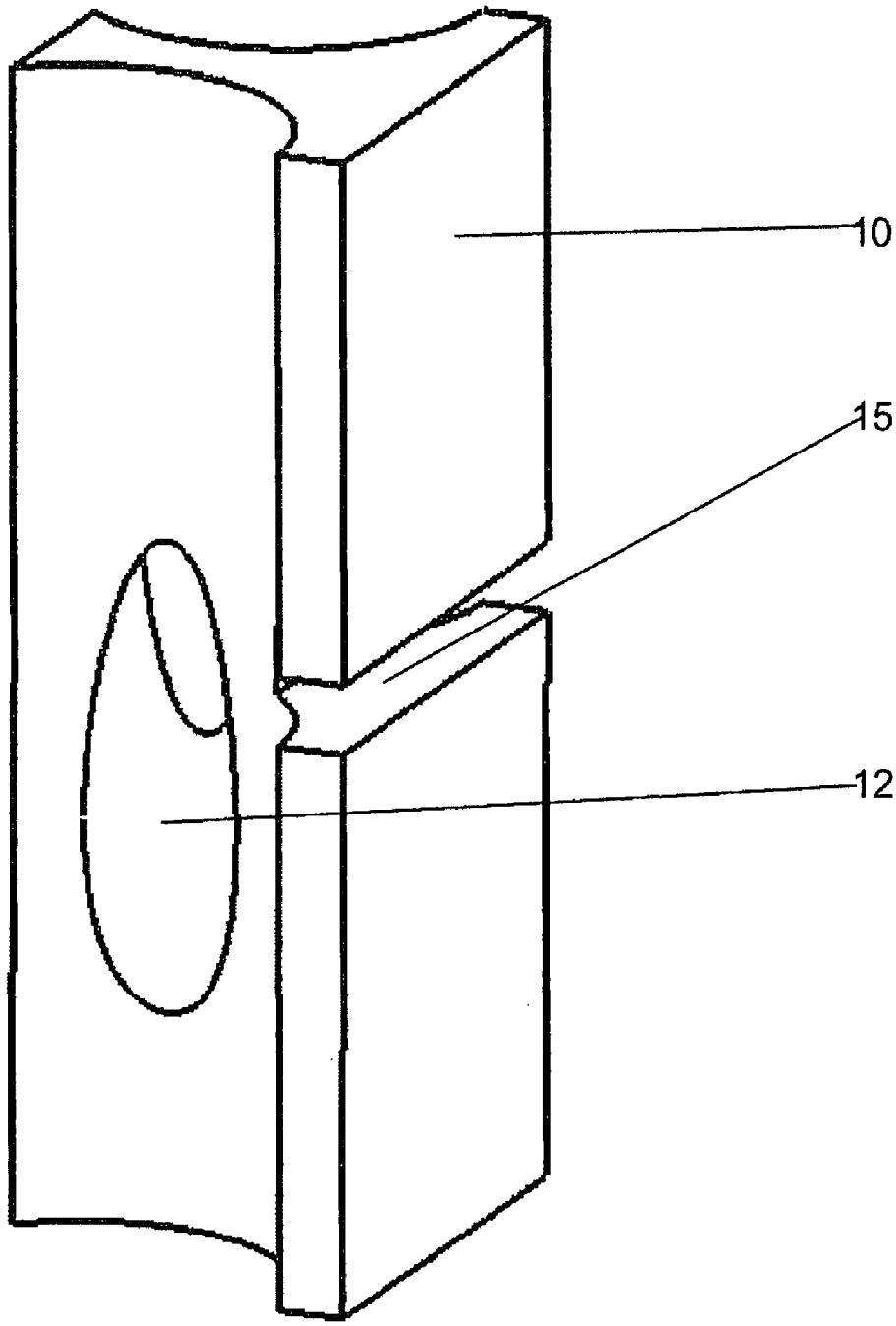

In contrast to the embodiments already described, FIGS. 9-11 show a development which also provides the possibility of improving refrigerant flow and/or of adapting such flow to specific peripheral conditions of a gas cooler in a cooling module of a motor vehicle. As is shown in FIGS. 9-11, an oblique through-hole 12 whose ends correspond to corresponding holes 23, 33 in the collecting tubes 2, 3 has been provided in the junction or connecting member 10, which is provided here as a pure junction member 10 but of course could also be embodied as a connecting member (or both). As a result, the refrigerant can be conducted, for example, from one section (e.g., at the top of one collecting tube 2) into another section (e.g., lying at the bottom of an adjacent collecting tube 3), or vice versa. Lower pressure loss can also be expected here due to the fact that refrigerant is not diverted so abruptly.

What is claimed is:

1. A heat exchanger comprising:

at least two fin/tube cores each having a collecting tube on each opposite sides of the fin/tube core, wherein adjacent collecting tubes on a common side of the fin/tube cores are in fluid communication with one another via a passageway extending between the adjacent collecting tubes;

a member received on two of the adjacent collecting tubes; and a plate engaged with the member and at least partially retaining the member in a position along the two of the adjacent collecting tubes;

wherein an aperture in the member establishes fluid communication between the two of the adjacent collecting tubes.

2. The heat exchanger of claim 1, wherein the plate extends across at least two adjacent collecting tubes and is received in an opening in the member.

3. The heat exchanger of claim 1, wherein the plate extends across a single collecting tube and is received in an opening in the member.

4. The heat exchanger of claim 1, wherein the plate is received within an opening in at least one of the collecting tubes.

5. The heat exchanger of claim 1, wherein the plate is received within an opening in each collecting tubes; and wherein the openings are located at a common position along the collecting tubes.

6. The heat exchanger of claim 1, wherein the aperture is defined in the member such that fluid passes in at least one of a first direction entering the member and a second direction exiting the member.

7. The heat exchanger of claim 1, wherein the plate comprises two adjacent bowl-shaped portions each positioned for insertion into a respective end of a collection tube.

8. The heat exchanger of claim 1, wherein the aperture establishes a fluid flow path between the collecting tubes that crosses the plate.

9. A heat exchanger, comprising:

a first fin/tube core coupled to a first collecting tube;

a second fin/tube core coupled to a second collecting tube and located adjacent the first collecting tube;

a member shaped to receive and extend about at least a portion of the circumference of each of the first and second collecting tubes; and a plate received within a portion of the member and at least partially retaining the member in place along the first and second collecting tubes;

wherein the plate is received within an opening on a side of the first collecting tube.

10. The heat exchanger of claim 9, wherein the first and second collecting tubes are substantially parallel to one another.

11. The heat exchanger of claim 9, wherein the member also extends to a location between the first and second collecting tubes.

12. The heat exchanger of claim 9, wherein the member is located at a position disposed from opposite ends of the collecting tubes.

13. The heat exchanger of claim 9, wherein the member is located proximate adjacent ends of the first and second collecting tubes.

14. A heat exchanger, comprising:

a first fin/tube core coupled to a first collecting tube;

a second fin/tube core coupled to a second collecting tube and located adjacent the first collecting tube;

a member shaped to receive and extend about at least a portion of the circumference of each of the first and second collecting tubes; and a plate received within a portion of the member and at least partially retaining the member in place along the first and second collecting tubes;

wherein the plate is received within an opening defined between portions of the member extending away from the first and second collecting tubes.

15. The heat exchanger of claim 14, wherein a portion of the plate is received in an open end of the first collecting tube.

16. The heat exchanger of claim 15, wherein another portion of the plate is received in an open end of the second collecting tube.

17. The heat exchanger of claim 9, wherein the plate is received within an opening on a side of the first collecting tube.

18. The heat exchanger of claim 9, further comprising an aperture in the member and through which fluid flows between a location within the first collecting tube and a location outside of the heat exchanger.

* * * * *